US005307556A

United States Patent [19]

Kido

[11] Patent Number: 5,307,556

[45] Date of Patent: May 3, 1994

[54] METHOD OF MANUFACTURING A MICRO-STRIP ANTENNA

[75] Inventor: Takashi Kido, Tokyo, Japan

[73] Assignee: Harada Kogyo Kabushiki Kaisha, Tokyo, Japan

[21] Appl. No.: 910,831

[22] Filed: Jul. 6, 1992

[51] Int. Cl.[5] ..... H01P 11/00

[52] U.S. Cl. ..... 29/600; 343/700 MS

[58] Field of Search ..... 29/600; 343/700 MS

[56] References Cited

U.S. PATENT DOCUMENTS 3,803,623 4/1974 Charlot, Jr. ..... 343/700 MS
4,067,016 1/1978 Kaloi ..... 343/700 MS
4,197,544 4/1980 Kaloi ..... 343/700 MS
4,291,312 9/1981 Kaloi ..... 343/700 MS
5,003,319 3/1991 Murakami et al. ..... 343/700 MS

*Primary Examiner*—Carl J. Arbes
*Attorney, Agent, or Firm*—Koda and Androlia

[57] ABSTRACT

A method of manufacturing a micro-strip antenna in which when a radiating conductor is installed on one side of a dielectric which has a grounding conductor on another side. A projection is installed at an edge portion of the radiating conductor and cut a specific amount so as to adjust the center frequency of the micro-strip antenna. Instead, such an adjustment of the center frequency of the micro-strip antenna is obtained by cutting away a part of an edge area of the radiating conductor a specific amount.

2 Claims, 5 Drawing Sheets

METHOD OF MANUFACTURING A MICRO-STRIP ANTENNA

BACKGROUND OF THE INVENTION

1. Field of the Invention

The present invention relates to a method of manufacturing a micro-strip antenna which can be used to receive satellite broadcasts, etc.

2. Prior Art

The conventional antenna shown in FIG. 6 is known as a micro-strip antenna. In this antenna, a dielectric 20 is installed on a grounding conductor 10, and a radiating conductor 30 such as copper foil, etc. is installed on the dielectric 20. Ordinarily, a substrate having copper foils on both sides of a dielectric is used as a micro-strip antenna; and a copper foil on one side of the dielectric is used as the grounding conductor 10, and a copper foil on another side is used as the radiating conductor 30 after being etched into a specific shape.

The center frequency of the micro-strip antenna varies depending upon the length of one side of the radiating conductor 30, the thickness of the dielectric 20, the dielectric constant of the dielectric 20, and other factors.

Normally, the reception frequency band width of a micro-strip antenna is 1 to 2% of the center frequency of the band to be received; and if errors occur somewhere in the material management and during the manufacturing process, etc. of the antenna, the center frequency may shift, causing the transmission frequency of satellite broadcasts not to fall within the reception frequency band of the micro-strip antenna. For example, if a substrate having a dielectric constant of 2.6 is used as the dielectric so that the antenna's center frequency is 1.575 GHz and the dimensional precision is set within a 200 micron range, then the center frequency can shift as much as about 10 MHz. If the center frequency of the reception frequency band is 1.575 MHz, the band width of such a frequency is in the range of 15.75 to 31.5 MHz; and if the dimensional precision of the antenna drops and other conditions are applied to the antenna, the center frequency of the micro-strip antenna would shift further, resulting in that the transmission frequency of the satellite broadcasts never fall within the reception frequency band of the antenna.

Thus, conventionally, it is difficult to manufacture micro-strip antennas with a uniform center frequency.

SUMMARY OF THE INVENTION

The object of the present invention is to provide a method of manufacturing a micro strip antenna in which the correction of the center frequency of the antenna is performed readily during the manufacturing process.

In the method of the present invention, a projection is formed at the circumferential area of a radiating conductor at a point or close thereto where an extension line, that extends from a line that connects the center of gravity of the radiating conductor and a feeding point, intersects an edge of the radiating conductor; and the projection is, instead, formed at a point or close thereto where a line, that crosses the extension line at the center of gravity, intersects an edge of the radiating conductor. Then, the projection is cut a specific amount in order to adjust the center frequency of the micro-strip antenna. Alternatively, in the present invention, the circumferential area of the radiating conductor may be cut a specific amount to obtain a projection, thus adjusting the center frequency of the micro-strip antenna.

BRIEF DESCRIPTION OF THE DRAWINGS

FIG. 2(*b*) is a front view thereof;

FIG. 5(*b*) is an explanatory diagram of still another embodiment of the present invention.

DETAILED DESCRIPTION OF THE INVENTION

Figure 1:
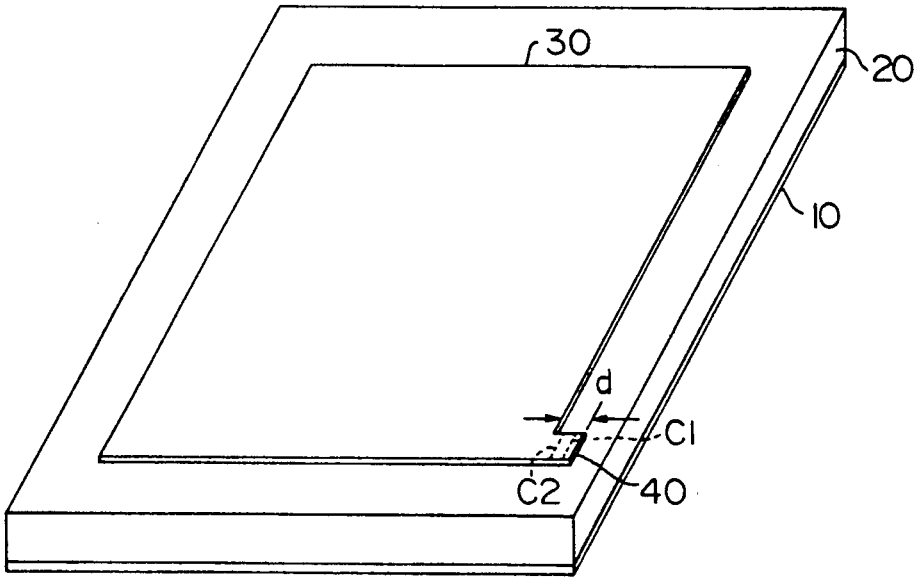
FIG. 1 is a perspective view of one embodiment of the present invention.

FIG. 1 shows one embodiment of the present invention.

In this embodiment, a dielectric 20 is installed on a grounding conductor 10, and a radiating conductor 30 is installed on the dielectric 20. The radiating conductor 30 has a projecting portion 40 on the edge, which is formed during the process preparing the radiating conductor 30. In other words, when the radiating conductor 30 and the ground conductor 10 are installed on either side of the dielectric 20, the projecting portion 40 that projects from the edge of the radiating conductor 30 is formed. Afterward, a part of the projecting portion 40 is cut a specific amount so that the projecting portion 40 has a projecting amount d at which the center frequency of the micro-strip antenna is adjusted.

The sizes of the grounding conductor 10 and the dielectric 20 can differ depending upon the frequency level of the signals to be received. In this embodiment, it is assumed that 1.5 GHz signals are received. Thus, in view of the 1.5 GHZ signals, the conductor 10 and the dielectric 20 are about 7 cm square shape, respectively. The size of the radiating conductor 30 can also differ depending upon the frequency level of the signals to be received. The length of the edge of the square radiating conductor 30 is approximately ¼ the reception wavelength; and in view of this wavelength, the radiating conductor 30 in this embodiment is approximately 5 cm square.

In actuality, the shape of the radiating conductor 30 including the projecting portion 40 is first designed so that the center frequency of the micro-strip antenna would be slightly lower than the desired center frequency, and then the projecting portion 40 is cut gradually so that the frequency is gradually raised. When a desired frequency is reached, the cutting is stopped. For instance, the center frequency is adjusted by increasing the amount of cutting so that the cutting is performed up to line C1, and if the center frequency is still too low, then a further cutting is made up to line C2, and so on. For cutting the projecting portion 40, a sand blasting method or a laser cutting method, for example, are used. If appropriate, the projecting portion 40 is cut with a knife.

Figure 2A:
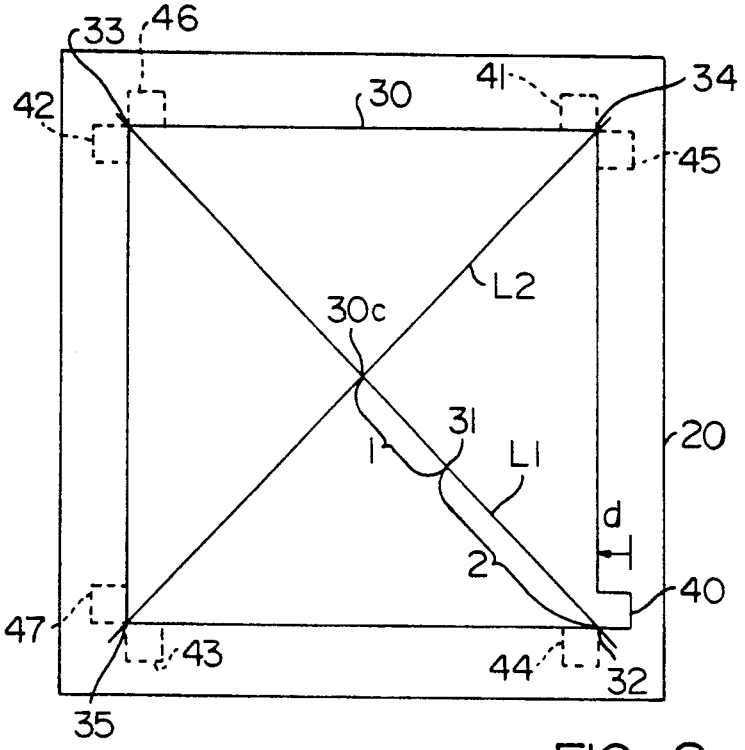
FIG. 2(*a*) is a top view showing a position where a projecting portion is provided in the embodiment.
Figure 2B:
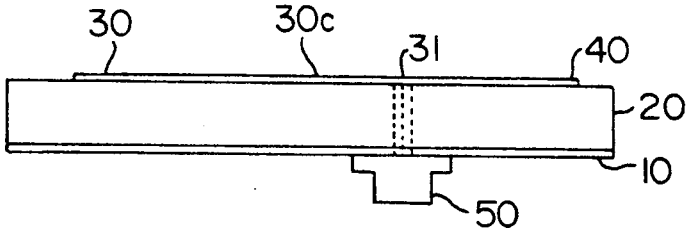

FIG. 2 illustrates the positions of the projecting portion 40, in which FIG. 2(*a*) is a top view and FIG. 2(2) is a front view thereof, respectively.

The radiating conductor 30 is positioned approximately at the center of the dielectric 20, and a connector 50 is installed directly beneath a dividing point (feeding point) 31. The dividing (or feeding) point 31 is located on a straight line, which connects the center of gravity 30*c* of the radiating conductor 30 and the corner 32, except for the projecting portion 40, of the radiating conductor 30. In other words, the dividing (or feeding) point 31 is at a distance 1 from the center of gravity 30*c* and a distance 2 from the corner 32. The core wire of the connector 50 is connected to the radiating conductor 30, and the outer-covering conductor of the connector 50 is connected to the grounding conductor 10.

The projecting portion 40 is, in fact, an example of a projection formed at the edge of a radiating conductor and located at approximately a point where an extension line, that extends from a line which connects the center of gravity of the radiating conductor and the feeding point, intersects the edge of the radiating conductor or at approximately a point where a line, that crosses the extension line at right angles at the center of gravity, intersects another edge of the radiating conductor.

More specifically, any projecting portion at an edge of the radiating conductor 30 can be used as the projecting portion 40. In other words, the projecting portion formed at approximately the point 32 or 33 where an extension line L1, which extends from a line which connects the center of gravity 30*c* of the radiating conductor 30 and the feeding point 31, intersects the edge of the radiating conductor 30 can be used as the projecting portion 40. Alternatively, the projecting portion formed at approximately the point 34 or 35 where a line L2, that crosses the extension line L1 at right angles at the center of gravity, intersects the edge of the radiating conductor 30 can be used as the projecting portion 40. More specifically, the position for installing the projecting portion 40 may be any one of the positions 41, 42 and 43, which are indicated by broken lines, or any one of the positions 44, 45, 46 and 47, which are also indicated by broken lines, instead of the position indicated by 40 in FIG. 2. In this case, the selection among the positions 40 through 43 and the positions 44 through 47 is made depending upon whether the circular-polarized waves are right-polarized waves or left-polarized waves. Furthermore, the projecting portion may be installed within a range of ±10 degrees of the respective positions 32, 33, 34 and 35 when viewed from the center of gravity 30*c*.

In FIG. 2(*a*), the projecting portion 40 projects in a lateral direction. A proper projecting amount of the projecting portion 40 is obtained by adjusting the projecting amount d by cutting until the center frequency of the antenna reaches a desired value. This can be done by connecting the micro strip antenna structured as described above to a network analyzer and observing the standing wave ratio (SWR).

If the center frequency of the signals to be received is other than 1.5 GHz, the size of the grounding conductor 10, the size of the dielectric 20, the size of the radiating conductor 30 and/or the dielectric constant of the dielectric 20 are changed in accordance with the reception frequency band before the projection amount d of the projecting portion 40 is adjusted.

Figure 3:
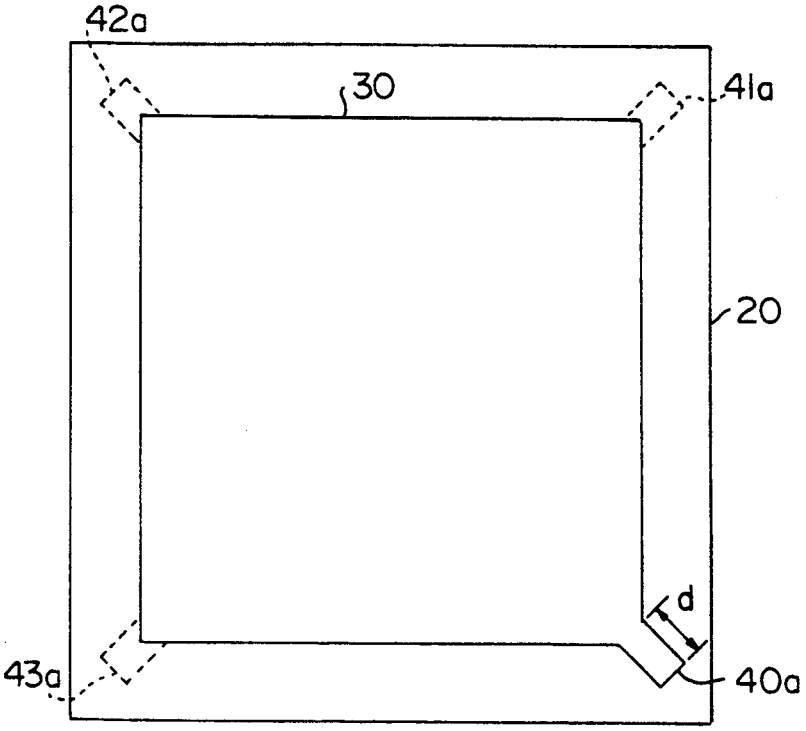
FIG. 3 is an explanatory diagram which illustrates another embodiment of the present invention.

FIG. 3 is an explanatory diagram of another embodiment of the present invention. In this embodiment, a projecting portion 40*a*, which is an equivalent to the projecting portion 40, is formed at a point, where the projecting portion 40 is formed in the above embodiment, so that the projecting portion 40*a* is oriented in the same direction as a diagonal line of the radiating conductor 30. Instead of installing the projecting portion 40*a*, it is possible to install a projecting portion at any one of the positions 41*a*, 42*a* and 43*a*, which are indicated by broken lines.

Figure 4:
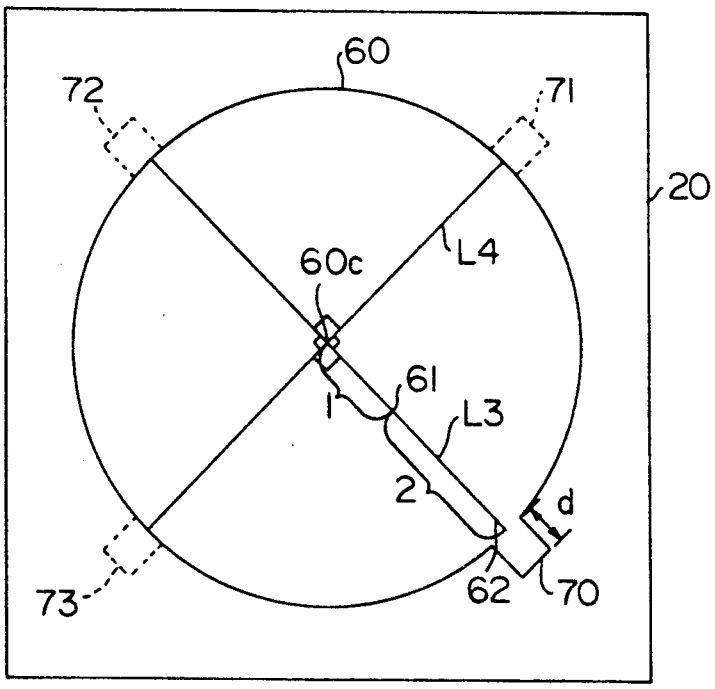
FIG. 4 is an explanatory diagram which illustrates still another embodiment of the present invention.

FIG. 4 is an explanatory diagram of still another embodiment of the present invention.

In this embodiment, the radiating conductor 60 installed on the dielectric 20 is circular in shape, and a projecting portion 70, which is an equivalent to the projecting portion 40, is formed on the edge 62 of the radiating conductor 60. This projecting portion 70 is formed at a position where d straight line, which connects the center of gravity 60*c* of the radiating conductor 60 and a position (feeding point) 61 where the core wire of a connector (not shown) is linked to the radiating conductor 60, intersects the edge of the radiating conductor 60. The position (or the feeding point) 61 where the core wire of the connector is connected is a point at a distance 1 from the center of gravity 60*c* and at a distance 2 from the edge of the radiating conductor 60.

When the center frequency of the micro-strip antenna shown in FIG. 4 is adjusted, it is only necessary to adjust the amount the projecting portion 70 projects from the radiating conductor 60. Furthermore, in this embodiment shown in FIG. 4, it would be possible to install a projecting portion, that corresponds to the projecting portion 70, at any one of the positions 71, 72 and 73, which are indicated by broken lines, instead of installing the projecting portion 70. In this case, the positions 71, 72 and 73 are where the projecting portion 70 is turned every 90-degrees about the center of the radiating conductor. In other words, projecting portion can be at either one of the points 62 and 72, which are essentially where an extension line L3, that extends from a line which connects the center of gravity 60*c* of the radiating conductor 60 and the feeding point, intersects the two edges of the radiating conductor 60, or at either one of the points 71 and 73 where a line L4, that crosses at right angles the line L3 at the center of gravity 60*c*, intersects two edges of the radiating conductor 60.

Though in the embodiments described above the projecting portions 40, 40*a* and 70 are square in shape, these projecting portions 40, 40*a* and 70 can be in a shape other than square. However, since acute-angled portions can be ignored due to the skin effect, forming of the projecting portions in acute-angled shape is not very meaningful in terms of adjustment of the center frequency.

Figure 5A:
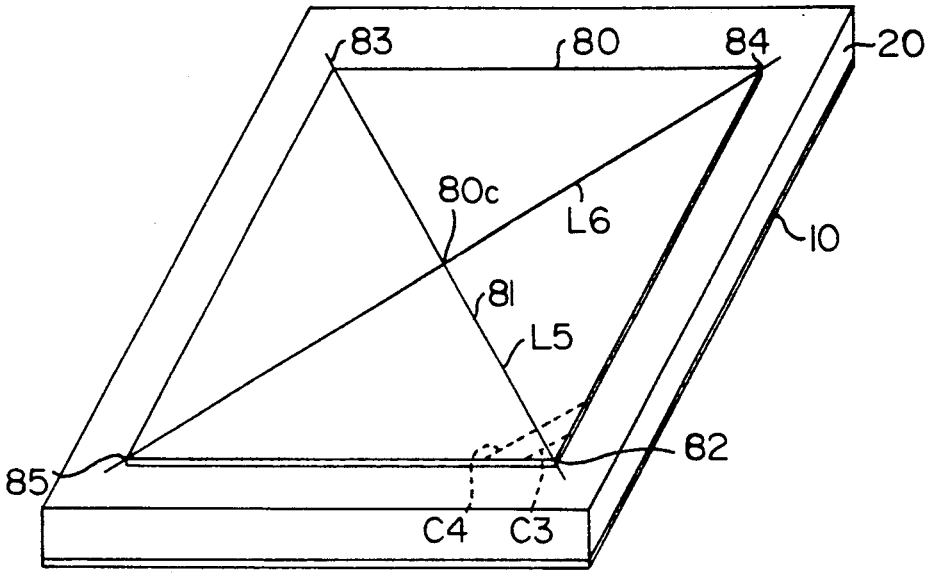
FIG. 5(*a*) is an explanatory diagram of still another embodiment of the present invention.
Figure 5B:
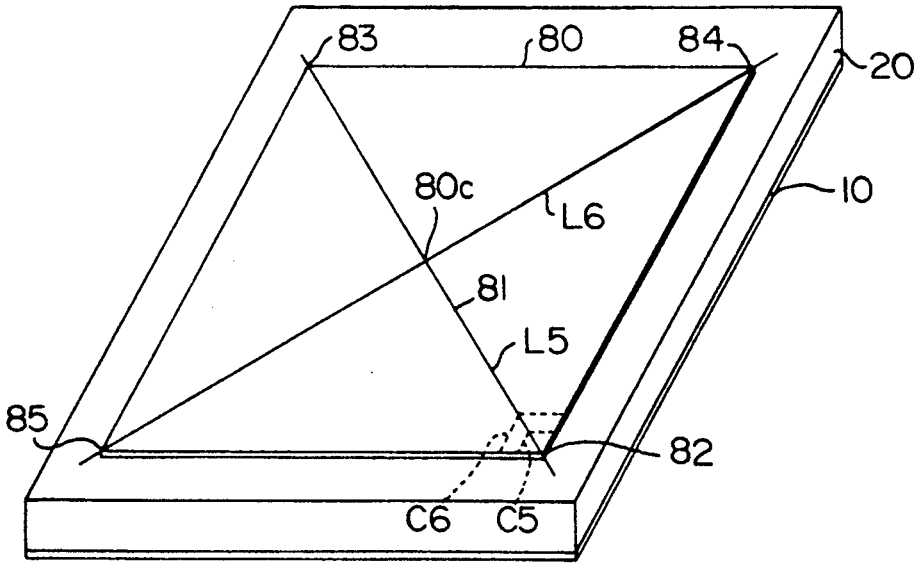
Figure 6:
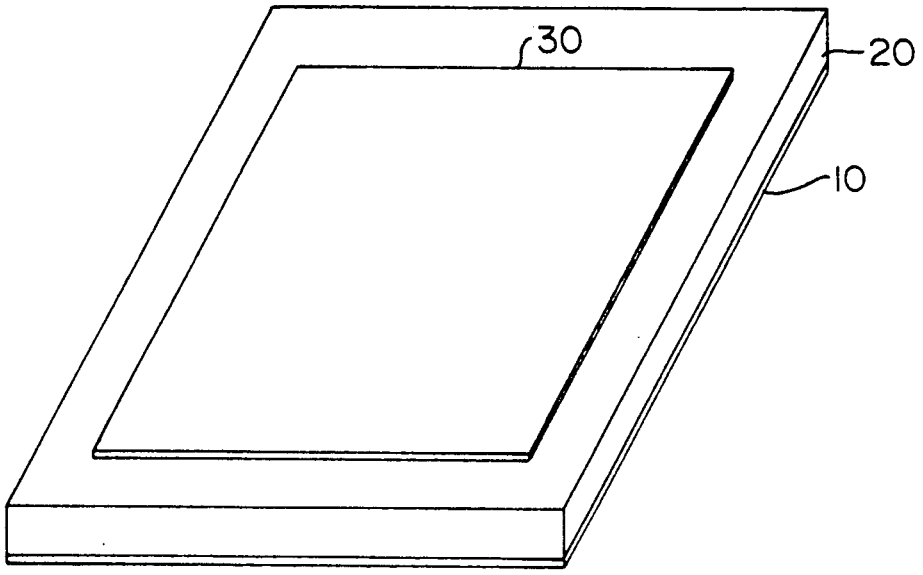
FIG. 6 PRIOR ART
FIG. 6 is a perspective view of one example of a conventional micro-strip antenna.

FIG. 5 is an illustration of still another embodiment. In this embodiment, edges of the radiating conductor 80, which is equal to the square conductor 30, are cut so as to adjust the center frequency of a micro-strip antenna.

In the case of FIG. 5(*a*), the corner 82 of the radiating conductor 80 is cut in a direction which is roughly perpendicular to the diagonal line of the radiating conductor 80. For example, the corner 82 of the radiating conductor 80 is cut along the lines C3, C4, and so on. This cutting can also raise the center frequency of the micro-strip antenna gradually. It would be possible to cut the corner of the radiating conductor 80 in a direction which is other than substantially perpendicular to the diagonal line of the radiating conductor 80. The corner 82 is a point where the extension line L5, that extends from a line which connects the center of gravity 80*c* of the conductor 80 and the feeding point 81, intersects the edge of the radiating conductor 80. However, instead of cutting the corner 82, it is possible to cut the radiating conductor at the point near the corner 82, to cut the radiating conductor 80 at near another point 83 where the extension line L5 intersects the edge of the conductor 80, and to cut the points which are near the points 84 and 85 where the extension line L6, that perpendicularly crosses the extension line L5 at the center of gravity, intersects the edges of the radiating conductor 80.

FIG. 5(*b*) illustrates another embodiment in which a corner of the radiating conductor 80 is cut in a square shape. For example, the corner 82 is cut along the L-shaped cutting lines C5, C6, and so on. In this case as well, the length of the edge of the radiating conductor 80 is gradually shortened as the cutting amount of the radiating conductor 80 is increased. Thus, the center frequency of the micro-strip antenna becomes gradually higher.

In the embodiments shown in FIG. 5, the center frequency of the micro-strip antenna is adjusted by cutting the edges of the square radiating conductor 80 a predetermined amount. However, instead of cutting this way, it would be possible to cut edges of a circular radiating conductor a predetermined amount toward the center. When the edges of a circular radiating conductor are cut a specific amount toward the center, the positions where the cuttings are made are the same as in the case of the square radiating conductor 80.

According to the present invention, the center frequency of the micro-strip antenna can be easily corrected during the manufacturing process thereof.

I claim:

1. A method of manufacturing a micro-strip antenna characterized in that a projecting portion projected from an edge of a radiating conductor is formed substantially at a point where an extension line, that extends from a line which connects the center of gravity of a radiating conductor and a feeding point, intersects an edge of said radiating conductor, or at a point where a line, that crosses said extension line perpendicularly at said center of gravity, intersects an edge of said radiating conductor, and a center frequency of said micro-strip antenna is adjusted upwardly by cutting said projecting portion a specific amount.

2. A method of manufacturing a micro-strip antenna characterized in that a square or circular radiating conductor is installed on one side of a dielectric which has a grounding conductor on another side to provide a micro-strip antenna having a center frequency lower than desired and a projecting portion is provided on said radiating conductor at a point where an extension line that extends from a line which connects a center of gravity of said radiating conductor and a feeding point, intersects an edge of said radiating conductor, or at a point where a line that crosses said extension line at said center of gravity, intersects an edge of said radiating conductor, and said center frequency of said micro-strip antenna is adjusted upwardly to said desired center frequency by cutting said projecting portion.

* * * * *